US005967807A

United States Patent [19]

Wu

[11] Patent Number: 5,967,807

[45] Date of Patent: Oct. 19, 1999

[54] AC/DC ELECTRIC ADAPTER WITH THE LARGE AND SMALL PLUGS

[75] Inventor: Michael Wu, Taipei Hsien, Taiwan

[73] Assignee: Formosa Electronic Industries Inc., Taipei Hsien, Taiwan

[21] Appl. No.: 08/915,651

[22] Filed: Aug. 20, 1997

[51] Int. Cl.[6] ..... H01R 13/44

[52] U.S. Cl. ..... 439/131; 439/956

[58] Field of Search ..... 439/131, 172, 439/521, 956

[56] References Cited

U.S. PATENT DOCUMENTS

| | | | |
|---|---|---|---|
| 4,997,381 | 3/1991 | Oh | 439/172 |
| 5,628,641 | 5/1997 | Hahn | 439/131 |
| 5,713,749 | 2/1998 | Wu | 439/131 |
| 5,829,993 | 11/1998 | Wu | 439/131 |

*Primary Examiner*—Neil Abrams
*Assistant Examiner*—T C Patel
*Attorney, Agent, or Firm*—Smith, Gambrell & Russell, LLP; Beveridge, DeGrandi, Weilacher & Young Intellectual Property Group

[57] ABSTRACT

This invention is an "improved AC/DC electric adapter with the large and small plugs". The main body of the device consists of upper and lower casings; inside the box, there is an electronic converting circuit. In its upper casing, there is an indentation design to hold the large plug; in the large plug, there is a small plug with the rotary pins. The small plug pins can be rotated into the ordinary formation (with the shape of "11") or the two angled formations because there are the following internal designs: two insulating pieces with three guiding holes and push-up pieces (the latter can make the pins mesh with the three guiding holes). Therefore, the small plug pins can be used to draw current from the regular socket or angled pin socket. In addition, its electronic converting circuit can convert the AC into low voltage DC. So, the invention can be used indoors. If we want to use the invention outdoors, we can extend its lighter socket plug outwards from the tube-shaped indentation in the lower casing to draw current from a cigarette lighter socket in an automobile, then this DC current will be converted into lower voltage current to be suitable for the some appliances.

7 Claims, 9 Drawing Sheets

AC/DC ELECTRIC ADAPTER WITH THE LARGE AND SMALL PLUGS

FIELD OF THE INVENTION

This invention is an "improved AC/DC electric adapter with the large and small plugs". With the large and small plugs in its upper casing, its pins can be rotated to fit different electrical sockets; with the lighter socket plug in its lower casing, we can use the adapter to draw current from a cigarette lighter socket in an automobile.

DESCRIPTION OF PRIOR ART

For the present time, when we travel abroad, we may carry some portable appliances like portable phone, electric shaver, portable CD player, notebook computer, etc. with us. If these appliances need to be charged, or if we want to connect these appliances with an electrical socket in a foreign country, we may find that the plugs of these appliances can not be inserted into these sockets directly (because these sockets require different kind of plug pins) or the local voltage does not match the voltage suitable for our appliances.

The electronic two-plug charger (U.S. Pat. No. 4,997,381) does provide partial solution to the above problems. The device consists of two plugs, and its small plug is kept in the indentation of the large plug. The small plug is held in the large plug by the following design: the expandable guiding piece in the large plug can mesh with the guiding hole of the small plug. We can extend the large plug or small plug outwards (its guiding piece should be retracted first). We can then insert its large or small plug into an electrical socket, and AC will be converted into DC to be used in charging.

The above charger can only be used for two kinds of sockets and can only be used for AC outlet (can not draw current from DC outlet as our invention), so it can only be used indoors (not for outdoor use). Therefore, its application range is not as wide as that of our invention.

The multiple-plug charger (U.S. Pat. No. 4,543,624) also provides some solution to the above problems. This device is equipped with a few sockets. An user has to shift its slider to select the proper socket and connect a proper plug into the socket so that the device can be used for different kinds of electrical outlets.

However, a user has to try each socket out, which is troublesome. In addition, this device can only be used indoors and can not be used to draw current from an automobile.

Another similar patented device is L-shape plug charger (U.S. Pat. No. 5,616,051). There are a few plugs provided along with the device. There is an indentation design in its casing to hold its pins; we can select the proper plug, and after the plug is mounted on the device, the pins are linked to the L-shape pieces to let the current passing through. Therefore, we can use its different L-shape plugs to draw current from different kinds of electrical outlets.

However, for the other plugs not in use, an user may lose them, which is troublesome. Moreover, children may get these plugs and insert one of them into electrical socket; this may cause electric shocks to the children. Another similar patented device is the contact lens cleaner (U.S. Pat. No. 4,973,827). In its back, there is an indentation design to hold the plug; when the plug is not in use, it can be kept in the indentation. The plug can be used for different kinds of electrical outlets.

As for the previous device, children may play with the detachable plug and get electric shocks. Also, an user may lose the plug easily. So, this may cause some trouble too.

SUMMARY OF THE INVENTION

To overcome the disadvantages of the above three products, the inventor came up with this new invention. This invention consists of upper and lower casings as well as electronic converting circuit. In its upper casing, there is an indentation design to hold the large plug; in the large plug, there is a small plug with the rotary pins. The small plug pins can be rotated into the ordinary formation (with the shape of "11") or angled formations because there are the following internal designs: two insulating pieces with three guiding holes and push-up pieces (the latter can make the pins mesh with the three guiding holes). Therefore, the small plug pins can be used to draw current from the regular socket or angled pin socket. In addition, its electronic converting circuit can convert the AC into low voltage DC. So, the invention can be used in the indoors (to supply the DC to small appliances). If we want to use the invention outdoors, we can extend its lighter socket plug outwards from the tube-shaped indentation in the lower casing to draw current from the cigarette lighter socket in an automobile, then this DC will be converted into lower voltage DC to be suitable for the some appliances. Therefore, the application range of this invention is wider than those of other products; because its large and small plugs are fixed in the upper casing, these plugs will not be lost.

The advantages of this invention are as the following: with the large and small plugs in its upper casing, its pins can be rotated to fit three different kinds of electrical sockets; with the lighter socket plug in its lower casing, we can use the adopter to draw current from a cigarette lighter socket in an automobile. Therefore, the application range of this invention is wider than those of other products.

BRIEF DESCRIPTION OF DRAWINGS

To let you have an accurate understanding of this invention, we provide the following diagrams for your reference.

Indention design: 11

Two slots on the metallic piece inside: 111

Electricity conducting piece: 12

Lower casing: 2

Tube-shaped indentation in the lower casing: 21

A pair of pivot unit on the lower part of the tube-shape indentation: 22

Axis hole on the pivot unit: 221
Rotation guiding pieces: 23
A few bumps on each guiding piece: 231
Large electric plug: 4 Front casing of the large plug: 411
Rear casing of the large plug: 412
Large plug body: 41 Two large plug pins: 42
Indentation design to hold the small plug: 413
Rotating axis unit: 4131 Axis holder unit: 4121
Rotating pivot: 410
Electricity conducting pieces: 414
Two holes on the rear casing: 415 Rotation guiding unit: 4161
Guiding spring: 416 Small electric plug: 5
Small plug body: 51
Two rotation axes: 510
Two round indentations: 511 A few holes: 512
Two rotary pins: 52
Two insulating pieces: 521
Three guiding holes: 521*a* Rod: 522
Push-up piece: 53 Lighter socket plug: 6
Cylinder: 61 Short rotation axis: 611
Small indentations in the cylinder: 612
Electronic converting circuit: 3

DETAILED DESCRIPTION OF PREFERRED EMBODIMENT

Figure 1:
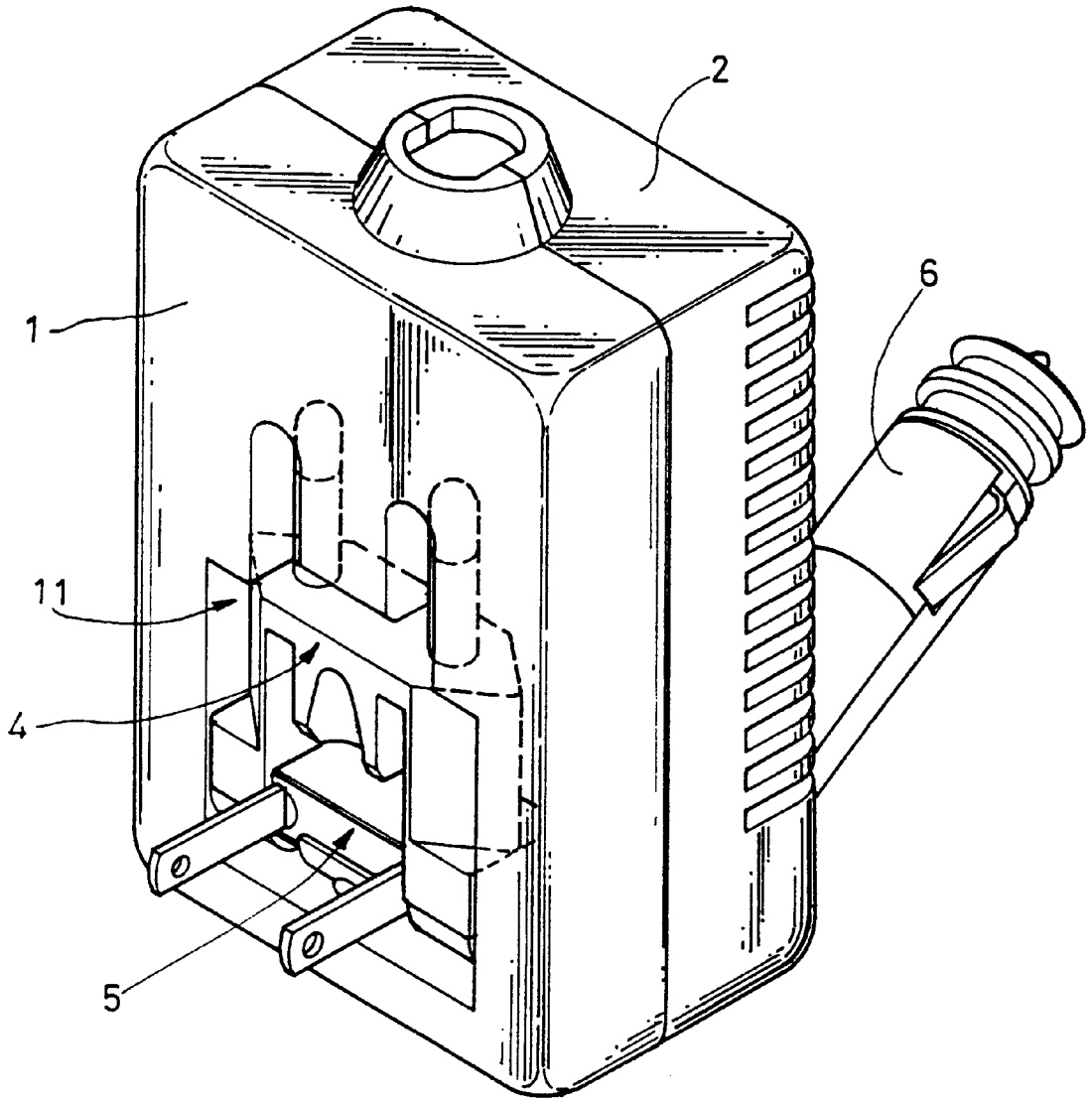
FIG. 1: The overall appearance of this invention
Figure 2:
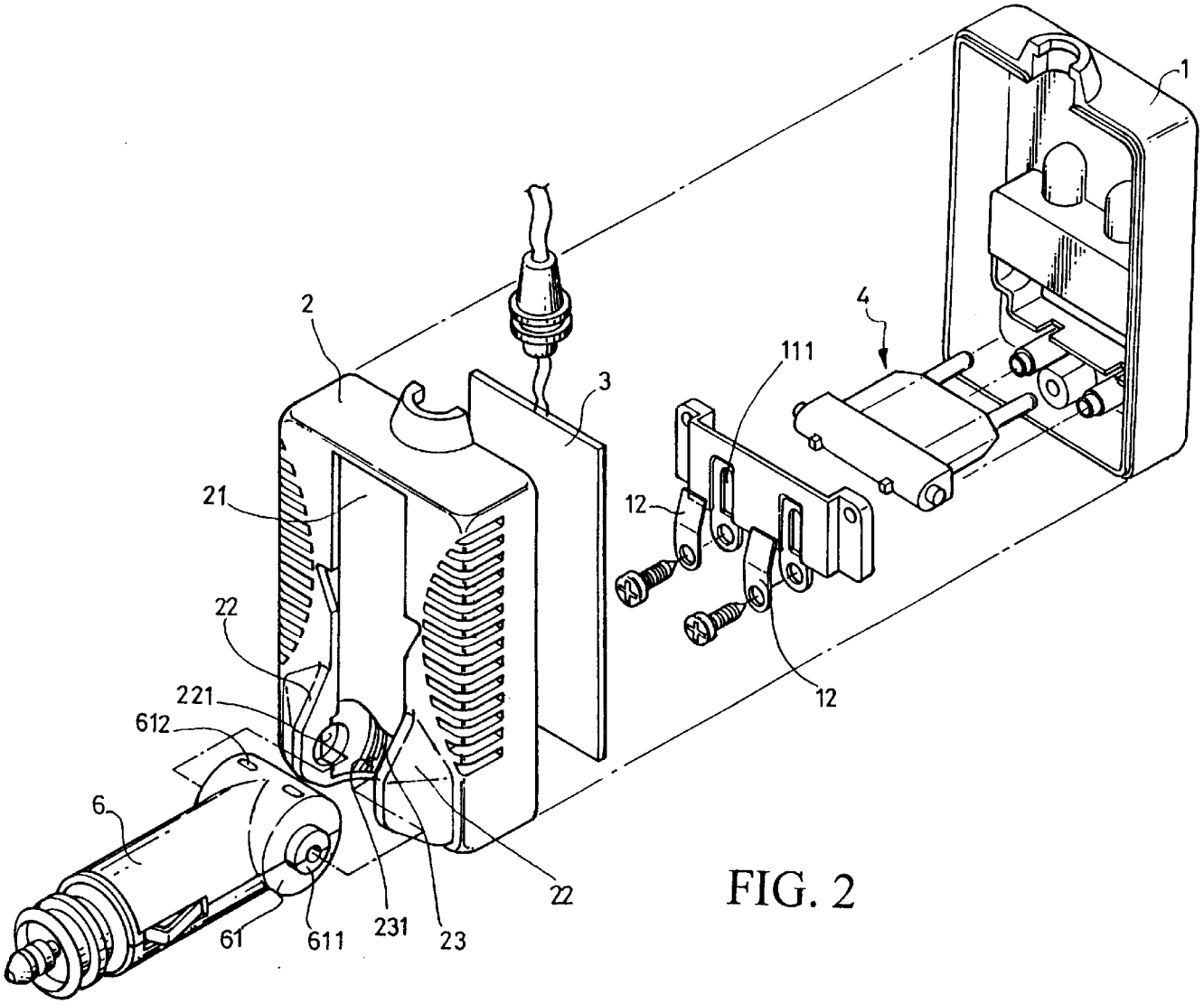
FIG. 2: The 3-D cutaway Fig. of this invention
Figure 3:
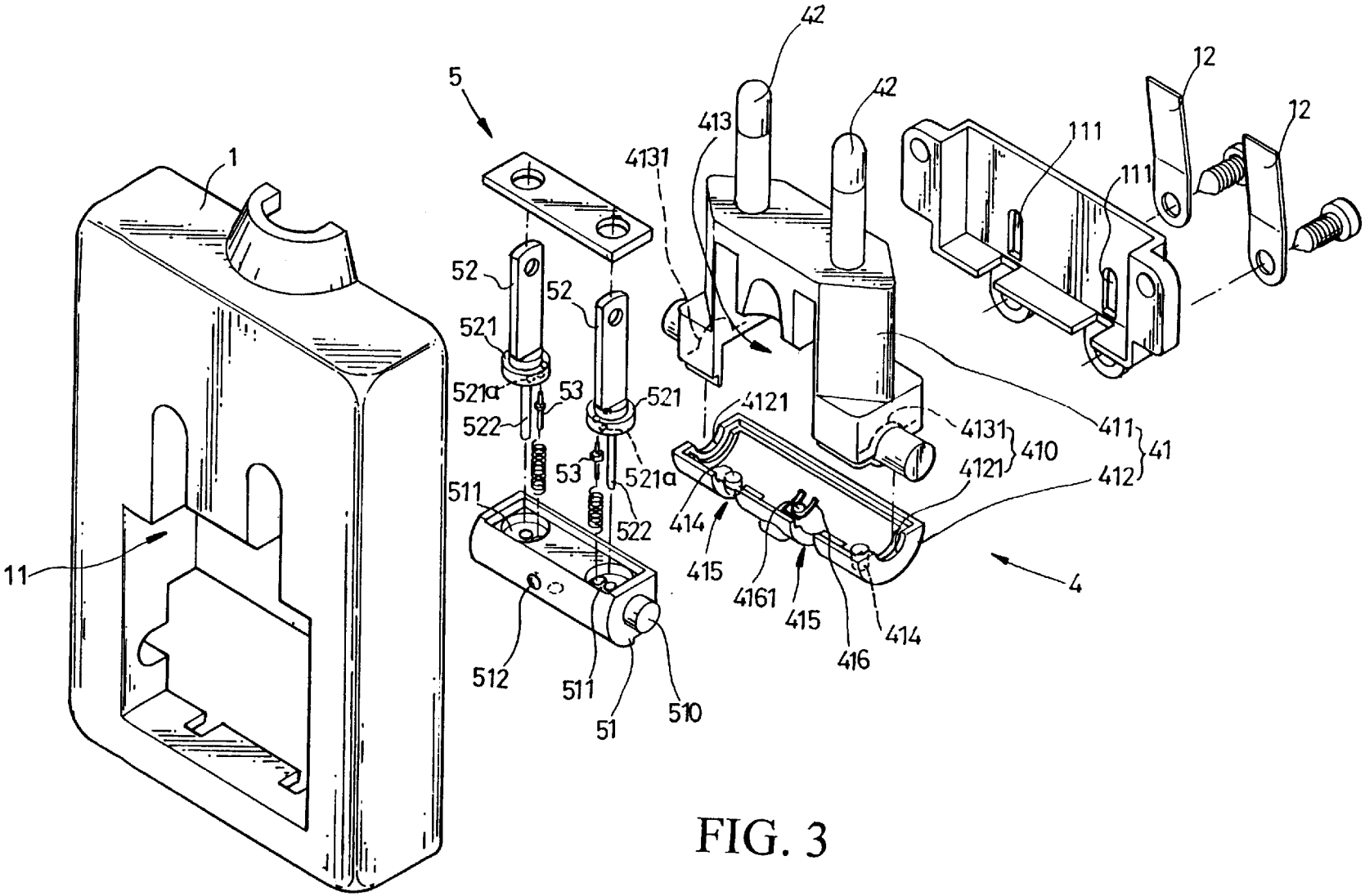
FIG. 3: The 3-D cutaway Fig. of the upper casing of this invention

As shown in FIGS. 1, 2 and 3, the main body of the invention consists of upper casing (1) and lower casing (2); inside the box, there is an electronic converting circuit (3), which can lower the DC voltage or convert AC to DC. On its upper casing, there are the large electric plug (4) and small electric plug (5); with these plugs, we can draw current from AC sockets with different voltage ratings. On the lower casing, there is a lighter socket plug (6), which can be used to draw current from the cigarette lighter socket of an automobile.

On its upper casing, there is an indention design (11) to hold the plugs, and there two slots (111) on the metallic piece inside. Below each slot, there is a electricity conducting piece (12).

The large plug (4) is housed inside of the indention design (11). The main plug body (41) is composed of the front casing (411) and rear casing (412). There are two legs (42) and imbedded indentation design (413) at the front casing of the main plug (411). Under the indentation design (413), there are the rotating axis unit (4131) and corresponding axis holder unit (4121); these two units form an rotating pivot (410). On the rear casing (412) of the large plug, there are the electricity conducting pieces (414), which are connected to the two large plug pins (42). There are two holes (415) on the rear casing (412), and, at the central part of the interior of the rear casing (412), there is the guiding spring (416) with the rotation guiding unit (4161). Therefore, the large plug can be folded back into the indentation design (11), and also can be extended outwards so that its rear terminals (412) are connected to the two electricity conducting pieces (12).

Figure 4:
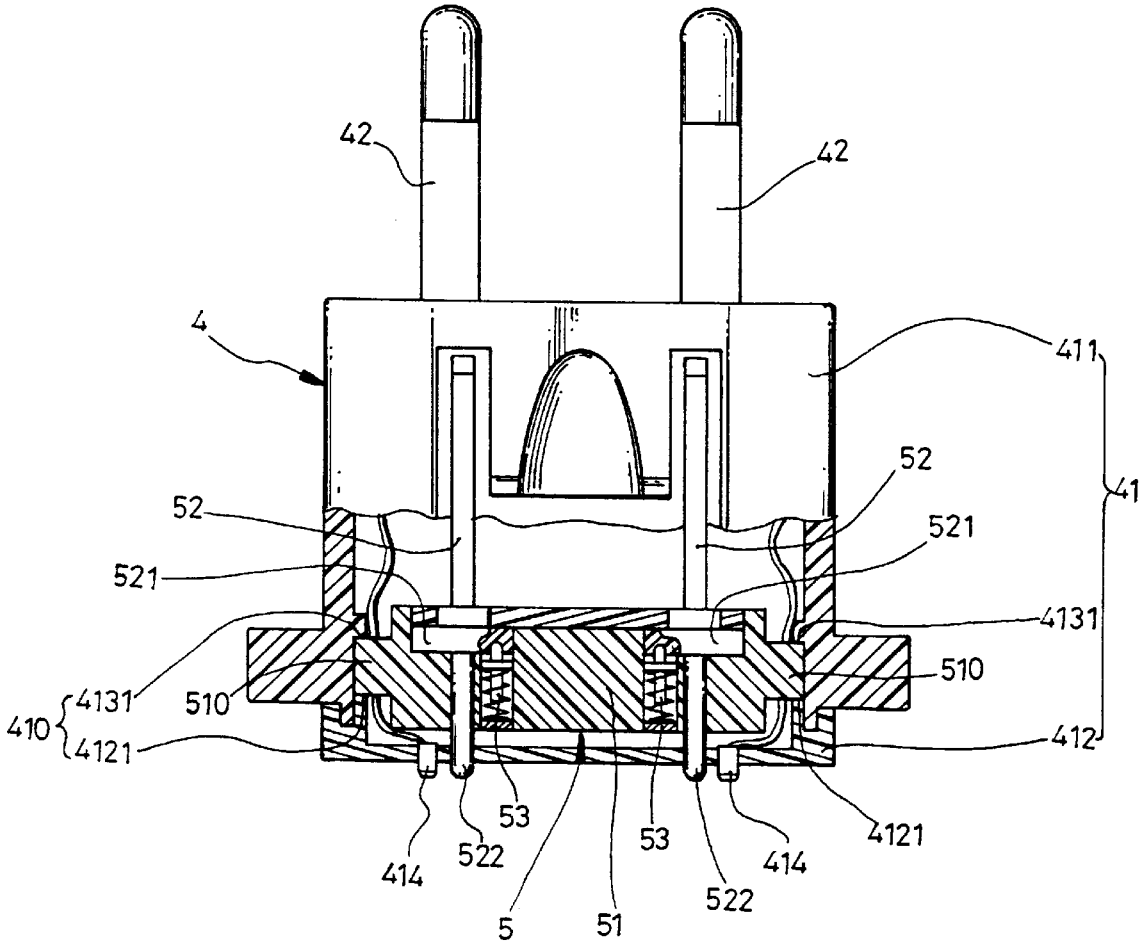
FIG. 4: A cross sectional view of the large and small plugs

About its small plug (5), there are two rotation axes (510) on both sides of its main body (51) and these two axes are housed in the rotation pivots (410) formed by the rotating axis unit (4131) and axis holder unit (4121) as mentioned previously. With these designs, the small plug can be folded into the imbedded indentation (413) in the large plug. In the main body (51), there are two round indentations (511) and a few holes (512). The two rods connected to the rotary pins (52) are inserted into these two indentations. There are two insulating pieces (521) at the bases of the pins, and there are three guiding holes (521*a*) on each of these pieces. Each pin is connected with a rod (522), and there is a push-up piece (53), which pushes the legs outwards, inside of each indentation (511). Each push-up piece in inserted into a guiding hole (521*a*) on the insulating piece. Therefore, the two rotary pins (legs) can be rotated to different angles, and the whole small plug can be extended outwards. If the plug is folded outwards, the two rods (522) connected to the plug pins are connected to the electricity conducting piece (12), which was mentioned before; also, rotation guiding unit (4161) can be held in the holes (512) and, so, the small plug can be properly positioned and guided as shown in FIG. 4.

Figure 5:
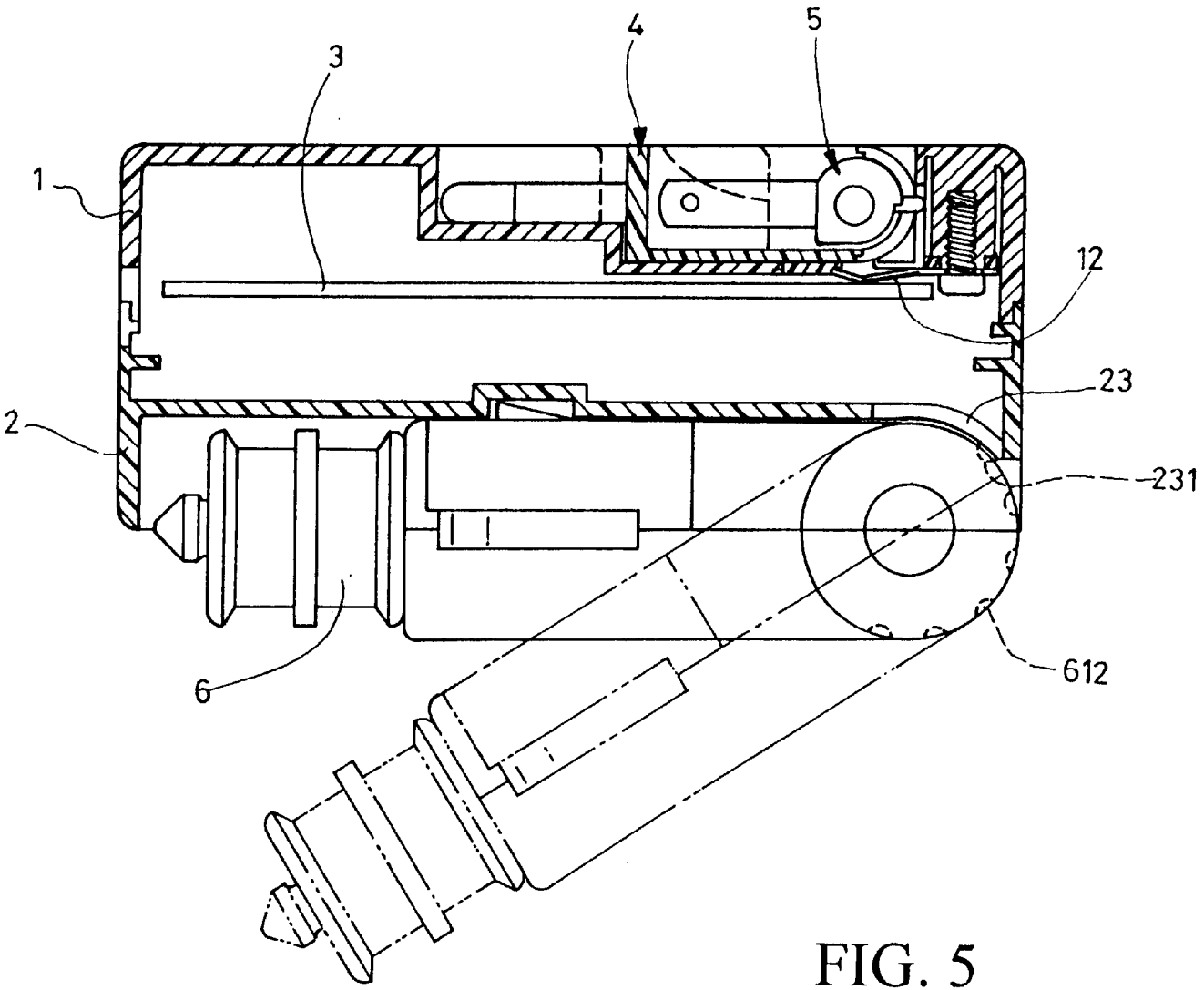
FIG. 5: A cross sectional view of this invention

About the lower casing (2), there is a tube-shaped indentation (21) in the casing. On the lower part of the indentation, there are a pair of pivot unit (22), and there is a axis hole (221) on the pivot unit (22). In the indentation, there are a few rotation guiding pieces (23), and there are a few bumps (231) on each guiding piece. Therefore, the lighter socket plug unit (6) can be installed at the pivot unit (22). In addition, there is a cylinder (61) at the base of the plug unit. At each side of the cylinder, there is a short rotation axis (611). Also, on the spherical surface of the cylinder (61), there are a few small indentations (612) (to mesh with the bumps as mentioned before). The two short rotation axes are inserted into the two axis holes (221) on the two pivot units (22) to get the plug unit (6) properly connected to the two pivot units (22) of the lower casing (2). To guide the plug unit (6) into the proper position when being extended outwards, there are the bumps (231) that mesh with the small indentations (612) in the cylinder (61) as shown in FIG. 5.

Figure 6:
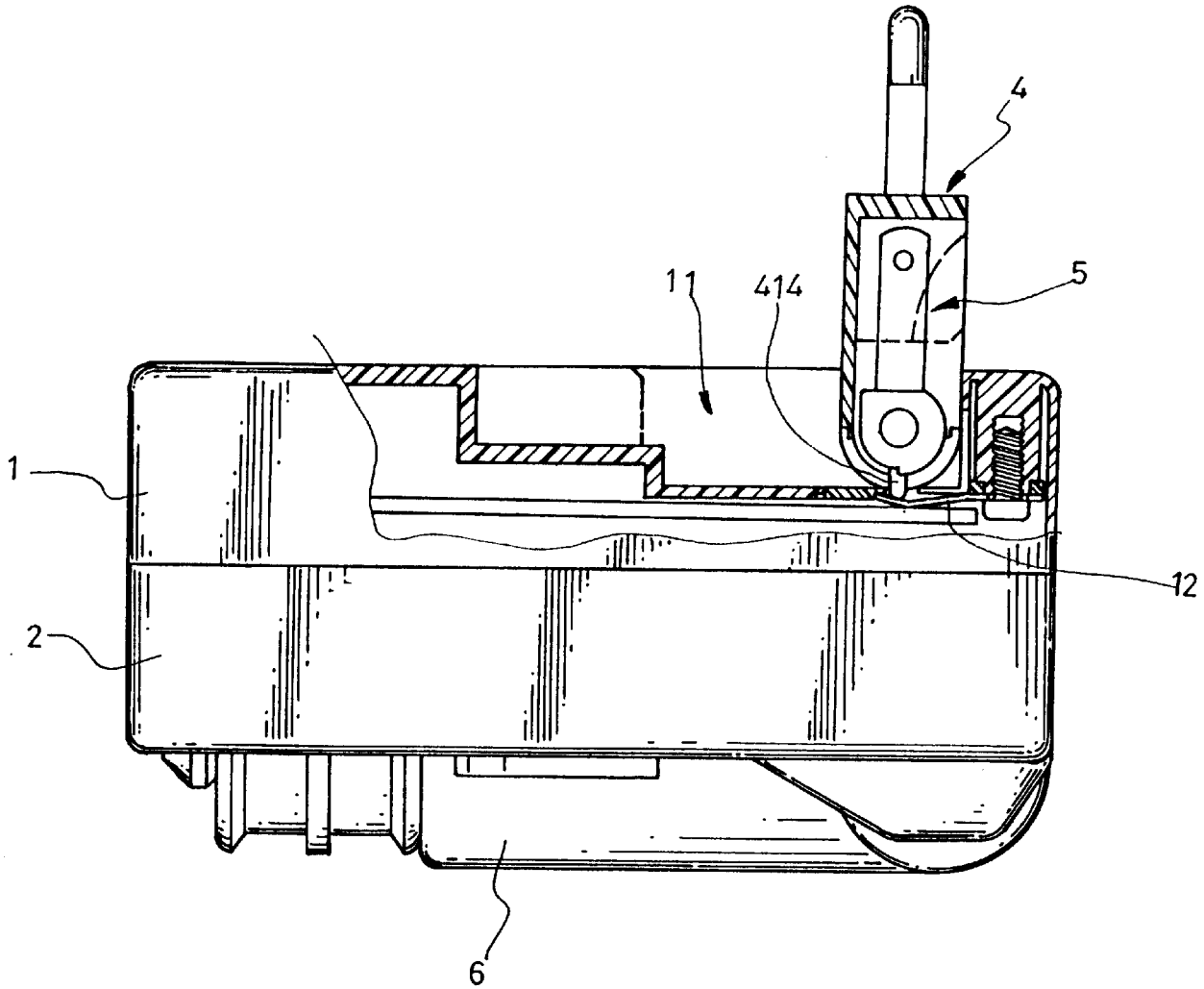
FIG. 6: A cross sectional view of this invention with the large plug extended outwards

To draw current from an indoor electrical socket (which can be inserted by the large plug pins) by using the power supply, we can use its large plug (4) by extending it outwardly. So, the electricity conducting terminals (414) at the rear of rear casing (412) will press against the electricity conducting piece (12) of the upper casing (1). Then, we should insert the large plug into an indoor electrical socket (not shown in FIG. 6). Therefore, we can draw current from an AC socket and get this current converted into low voltage DC via its electronic converting circuit (3); then, this DC current can be used for small electrical appliances or be used to charge electrical appliances (as shown in FIG. 6).

Figure 7:
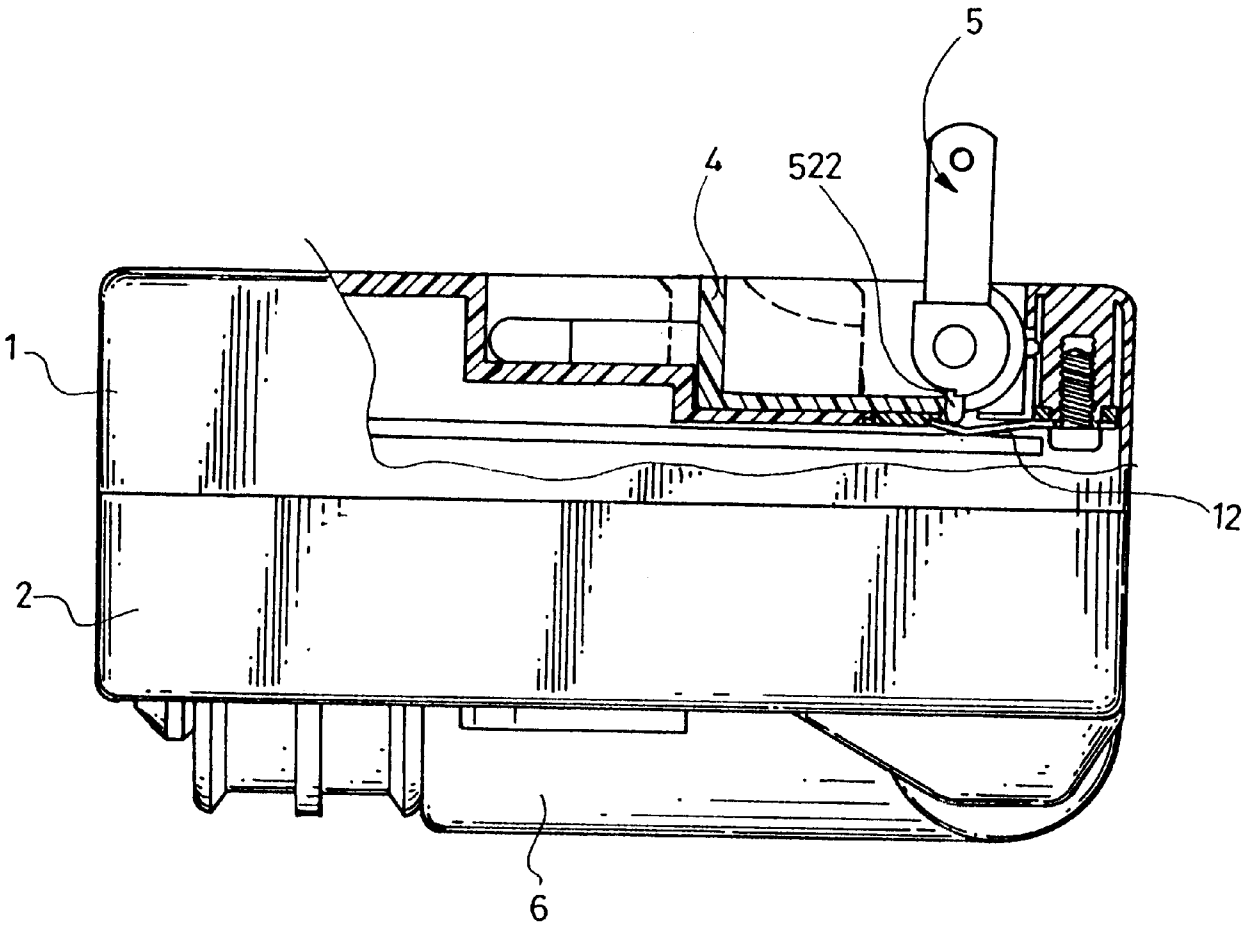
FIG. 7: A cross sectional view of this invention with the small plug extended outwards
Figure 8:
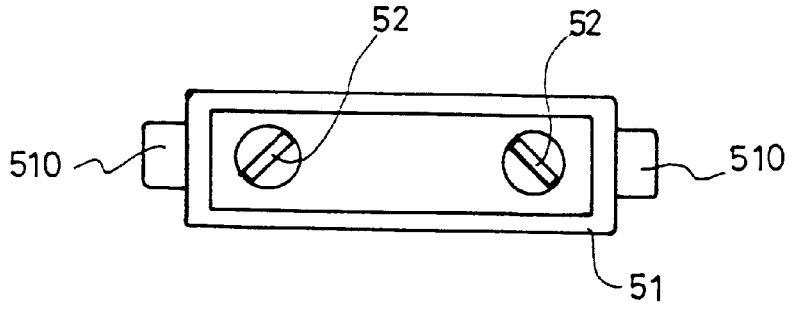
FIG. 8: A Fig. showing that the small plug pins can be rotated to the angled formation
Figure 9:
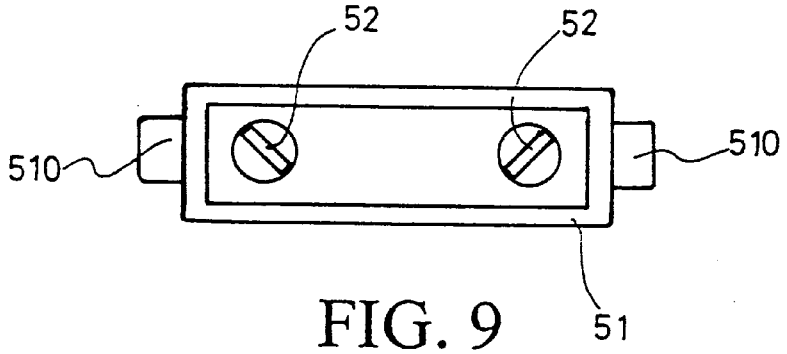
FIG. 9: A Fig. showing that the small plug pins can be rotated to another angled formation
Figure 10:
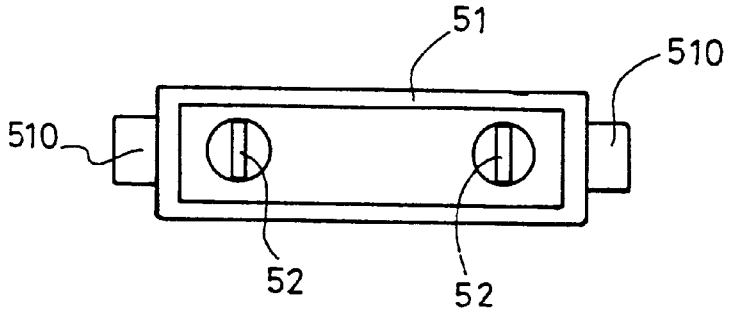
FIG. 10: A Fig. showing that the small plug pins can be rotated to the "11" formation
Figure 11:
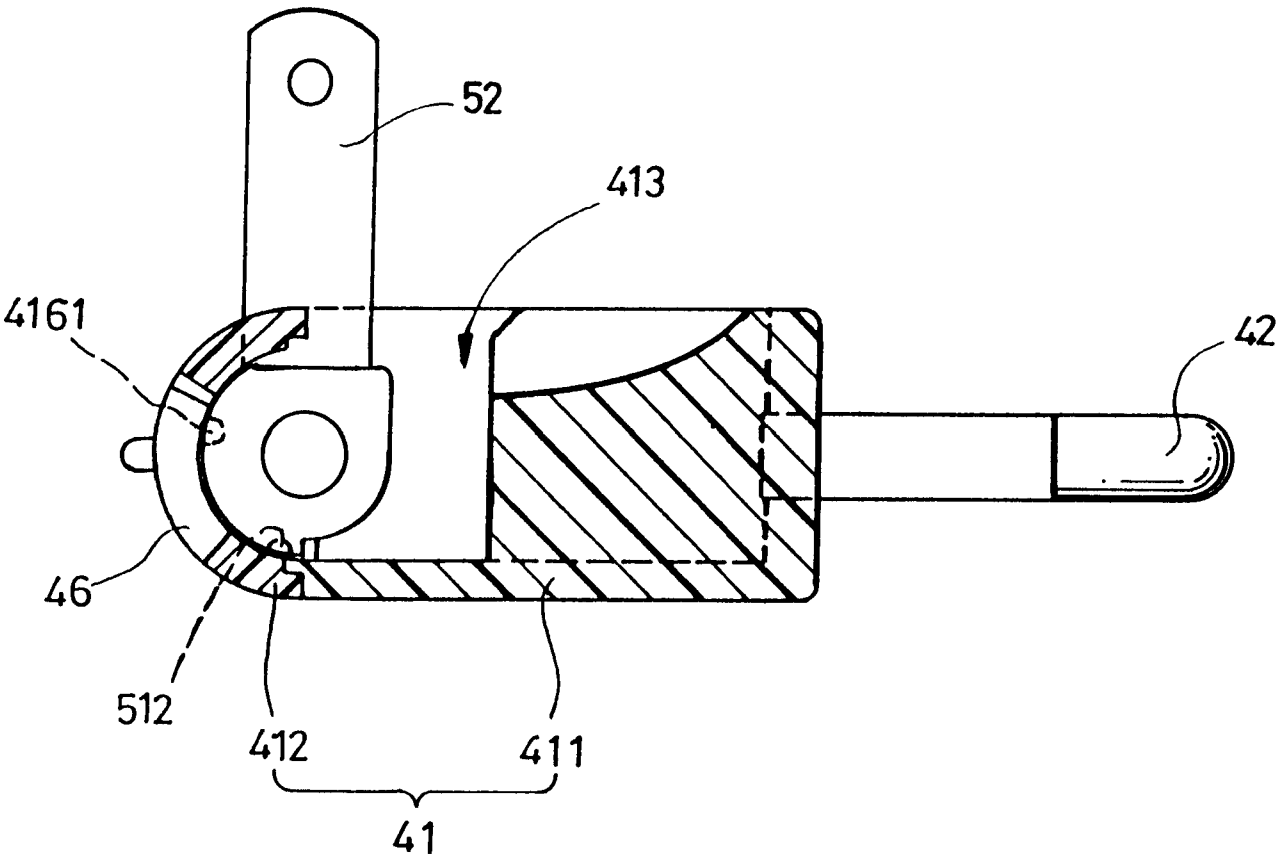
FIG. 11: A closer cross sectional view of its small plug after it is extended outwards Names of the parts and their corresponding numbers Upper casing: 1

If we want to use the invention for a socket that is the ordinary kind (with the shape of "11") or angled-pin kind, we can fold the large plug (4) into its indention design (11) and extend its small plug outwards. In this time, the two rear rods (522) of the small plug pins will press against the electricity conducting piece (12) as shown in FIG. 7. The small plug pins can be used to draw current from the regular socket or angled pin socket; the following are how this is done: the push-up piece (53) in the indentation (511) of main body (51) will mesh with the three guiding holes (521*a*) on each of insulating pieces (521) of rotary legs (52), and the pins can be converted to these three kinds of pin formations with its rotary pins (legs) (please see FIGS. 8, 9 and 10). In addition, the small plug pins can be firmly held down because the rotation guiding unit (4161) of guiding spring (416) on the rear casing (412) of the main plug (4) will mesh with the holes (512) at the rear part of the small plug (5).

With the combination of its large and small plugs, there are three different kinds of plug pins can be used; therefore, we can use this invention to draw current from different types of electrical sockets. In addition, because both plugs can be folded into the upper casing, we do not have to worry about losing the plug; so, this invention is very well designed.

Moreover, to draw current from a DC electrical outlet outdoors, we can extend the lighter socket plug (6) outwards and insert it into a cigarette lighter socket (not shown in FIG. 5) in an automobile. Then, the high voltage DC will be converted into low voltage DC by its electronic converting circuit (3) so that the latter can be used for the regular appliances. Therefore, for its outdoor application, we can use the lighter socket plug (6) to draw low voltage DC from cigarette lighter socket in an automobile.

This invention can be used to draw current from the regular electrical sockets in homes as well as automobiles; so, this invention has a wider range of applications. For its indoor uses, its large and small plugs make it possible to draw current from sockets of different types.

I claim:

1. An AC/DC electric adapter comprising:

a casing, an indentation in an outer wall of said casing, a first electric plug comprising a plug body and a pair of pins extending from said plug body, said body pivotally mounted on said casing within said indentation, said plug body provided with an indentation on a surface thereof, a second electric plug pivotally mounted on said first electric plug and within said indentation on said plug body, said second electric plug having a pair of pins extending outwardly, each of said pins of said second electric plug having an insulating piece affixed thereto, each of said insulating pieces having openings therein, a push-up piece extending into one of said openings in each of said insulating pieces whereby each of said pins and insulating piece can be rotated and locked in-place by inserting said push-up piece into a hole of said insulating piece, an electronic converting circuit within said case which converts alternating current to direct current and converts direct current to low voltage direct current, an electricity conducting piece in communication with said electronic converting circuit, whereby when said first electric plug or said second electric plug are pivoted so as to extend outwardly from said respective indentations and said casing for insertion into an electric socket, the pins of said plug are in electrical contact with said electricity conducting piece and said electronic converting circuit.

2. The AC/DC electrical adapter as defined in claim 1 further comprising:

a second indentation in an outer wall of said casing, a lighter socket plug unit pivotally mounted on said casing within said second indentation, said lighter socket plug unit being in electrical communication with said electronic converting circuit when said lighter socket plug unit is pivoted to extend outwardly from said second indentation and said casing for insertion into a lighter socket of an automobile so as to convert direct current from the automobile lighter socket to low voltage direct current.

3. The AC/DC electric adapter as defined in claim 1 wherein said casing comprises an upper casing and a lower casing and said indentation for said first electric plug is in an outer wall of said upper casing.

4. The AC/DC electric adapter as defined in claim 2 wherein said second indentation is in an outer wall of said lower casing.

5. The AC/DC electric adapter as defined in claim 3 wherein said pair of pins of said first electric plug are cylindrical.

6. The AC/DC electric adapter as defined in claim 5 wherein said pair of pins of said second electric plug are flat.

7. The AC/DC electric adapter as defined in claim 1 wherein said insulating pieces each have three openings.

* * * * *